US009097461B2

(12) United States Patent
Naboulsi, Jr.

(10) Patent No.: US 9,097,461 B2
(45) Date of Patent: Aug. 4, 2015

(54) SYSTEM TO REDUCE MOISTURE WITHIN A CLOTHES DRYER

(71) Applicant: Zain Abedien Naboulsi, Jr., Katy, TX (US)

(72) Inventor: Zain Abedien Naboulsi, Jr., Katy, TX (US)

( * ) Notice: Subject to any disclaimer, the term of this patent is extended or adjusted under 35 U.S.C. 154(b) by 153 days.

(21) Appl. No.: 14/012,739

(22) Filed: Aug. 28, 2013

(65) Prior Publication Data

US 2015/0059201 A1 Mar. 5, 2015

(51) Int. Cl.
*D06F 58/20* (2006.01)
*F26B 21/08* (2006.01)

(52) U.S. Cl.
CPC ..... *F26B 21/083* (2013.01)

(58) Field of Classification Search
CPC ..... F26B 3/00; F26B 5/00; F26B 19/00; D06F 58/00; D06F 58/20; A47L 15/00; A47L 15/42; F24H 3/00; F24H 3/02
USPC ..... 34/380, 381, 472, 80, 595, 606; 68/5 C, 68/5 R, 19, 20; 134/115 R; 165/8, 54, 66
See application file for complete search history.

(56) References Cited

U.S. PATENT DOCUMENTS

| | | | | | |
|---|---|---|---|---|---|
| 2,499,328 | A * | 2/1950 | Women | 34/80 |
| 2,960,780 | A * | 11/1960 | Stilwell, Jr. | 38/2 |
| 3,043,015 | A * | 7/1962 | Brucken | 34/80 |
| 3,739,487 | A * | 6/1973 | Clark | 34/77 |
| 4,125,946 | A * | 11/1978 | Prager | 34/80 |
| 6,094,835 | A * | 8/2000 | Cromer | 34/80 |
| 6,434,857 | B1 * | 8/2002 | Anderson et al. | 34/595 |
| 7,320,182 | B1 * | 1/2008 | Hsu et al. | 34/90 |
| 7,921,578 | B2 * | 4/2011 | McAllister et al. | 34/597 |
| 8,137,440 | B2 * | 3/2012 | Dewald et al. | 95/113 |
| 8,336,145 | B2 | 12/2012 | Dever et al. | |
| 2010/0115785 | A1 * | 5/2010 | Ben-Shmuel et al. | 34/260 |
| 2011/0061257 | A1 | 3/2011 | Balsillie | |
| 2011/0120513 | A1 | 5/2011 | Jerg et al. | |
| 2015/0059201 | A1 * | 3/2015 | Naboulsi, Jr. | 34/472 |

FOREIGN PATENT DOCUMENTS

| | | | | |
|---|---|---|---|---|
| DE | 3626887 | A1 * | 2/1988 | B01D 53/28 |
| JP | 60 119992 | * | 6/1985 | |

* cited by examiner

*Primary Examiner* — Steve M Gravini
(74) *Attorney, Agent, or Firm* — Plager Schack LLP

(57) ABSTRACT

A system reduces moisture within a clothes dryer. The system includes a housing comprising holes which permit the moisture from to enter and leave the housing. A cartridge is located within the housing. The cartridge is filled with a desiccant. The clothes dryer blows air continuously across the cartridge in many directions subjecting the desiccant to moist air in order to remove the moisture from the moist air and dry clothes in the clothes dryer faster.

10 Claims, 3 Drawing Sheets

SYSTEM TO REDUCE MOISTURE WITHIN A CLOTHES DRYER

BACKGROUND

The embodiments herein relate generally to devices used to dry clothing in a clothes drying machine.

A clothes dryer is a household appliance that is used to remove moisture from a load of clothing and other textiles, generally shortly after they are cleaned in a washing machine. Most dryers consist of a rotating drum called a tumbler through which heated air is circulated to evaporate the moisture from the load. The tumbler is rotated to maintain air space between the articles in the load.

Traditional dryers continuously draw in the cool, dry, ambient air around them and heat it before passing it through a screen with holes into the tumbler. The resulting hot, humid air is usually vented outside to make room for more dry air to continue the drying process. This process is not very efficient and the humidity causes clothes to dry slowly and can create environmental problems when released into the atmosphere. Removing this humidity has evaded a simple solution. The prior art includes: U.S. Patent Application Publication 2011/0061257 A1 filed by Balsillie, U.S. Patent Application Publication US 2011/0120513 A1 by Jerg; U.S. Pat. No. 4,125,946 issued to Prager; and U.S. Pat. No. 8,336,145 issued to Dever.

The Balsillie application involves filling a bag with some material then inserting the bag into the article that the user desires to dry. The Jerg application teaches a dishwasher with a sorption drying system that contains material which is fixed to the dishwasher and expedites drying of dishes by removing moisture from the atmosphere. The Prager device teaches clothes drying with a solar powered dehumidifier. Dever teaches a device for mitigating odor in an article of clothing or footwear. None of Balsillie, Jerg, Prager, or Dever teach a desiccant that is likely to be effective in a clothes dryer.

SUMMARY

A system reduces moisture within a clothes dryer. The system includes a housing comprising holes which permit the moisture from to enter and leave the housing. A cartridge is located within the housing. The cartridge is filled with a desiccant. The clothes dryer blows air continuously across the cartridge in many directions subjecting the desiccant to moist air in order to remove the moisture from the moist air and dry clothes in the clothes dryer faster.

In some embodiments, the housing is a ball. In some embodiments, the housing is a bar affixed to the clothes dryer with an adhesive. In some embodiments, the housing is a bracket assembly mechanically coupled to the clothes dryer. The desiccant can be a molecular sieve.

A process for removing moisture from a clothes dryer containing wet clothes enables faster clothes drying and reduces an amount of moisture released from the clothes dryer into an ambient environment. The process includes the following steps not necessarily in order. A user perforates a housing with perforations. The user inserts a cartridge into the housing wherein the cartridge is filled with a desiccant. The user then engages the clothes dryer to blow moist air continuously across the housing. The desiccant removes the moisture from the moist air permitting faster clothes drying and reducing the amount of moisture released from the clothes dryer into the ambient environment.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
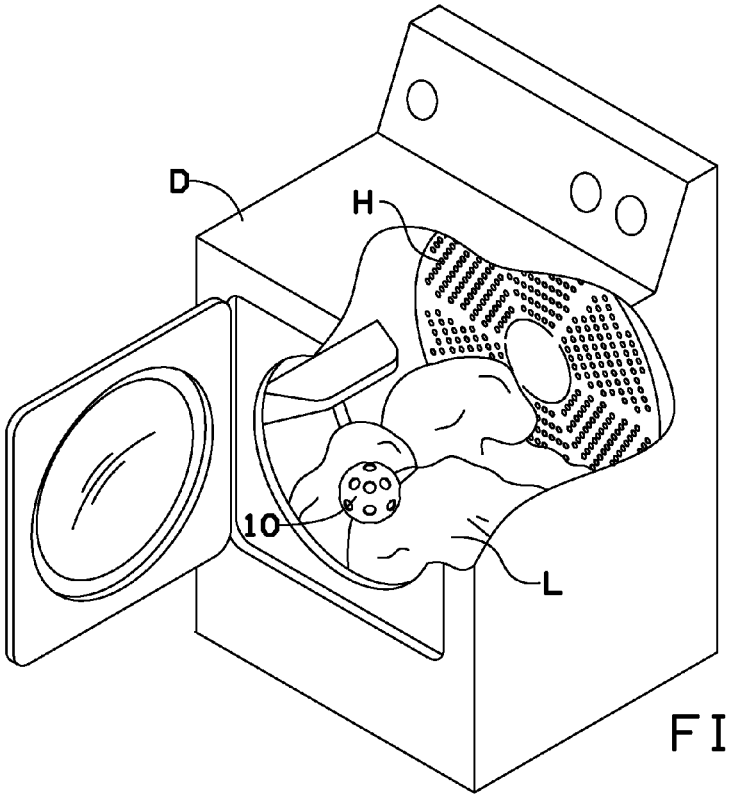
FIG. 1 is a perspective view of an embodiment of the invention shown in use.
Figure 2:
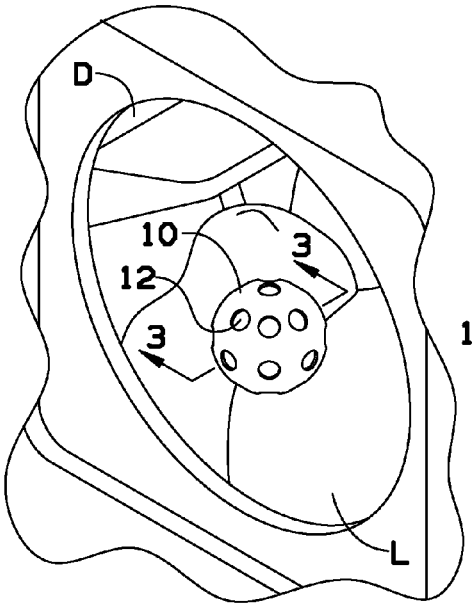
FIG. 2 is a detailed perspective view of an embodiment of the invention shown in use.
Figure 3:
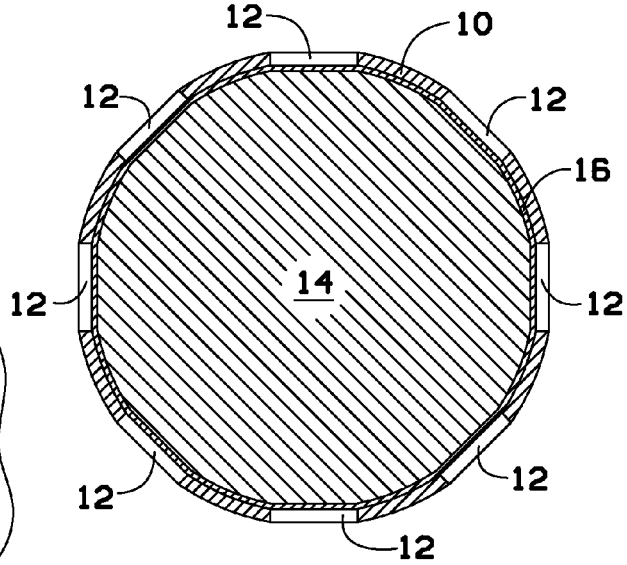
FIG. 3 is a section view of an embodiment of the invention taken about line 3-3 in FIG. 2.

By way of example, and referring to FIG. 1, FIG. 2 and FIG. 3, clothes dryer D brings in air through holes H and can accommodate laundry L. One embodiment of the present system comprises ball 10 which can be set in dryer D in order to more efficiently dry laundry L.

Housing 10 comprises a plurality of perforations 12. Housing 10 can further accommodate desiccant 14. Desiccant 14 can be in cartridge 16 that permits moisture to travel through perforations 12 where the moisture is exposed to desiccant 14. This causes moisture to be removed from laundry L allowing laundry L to dry and preventing excessive moisture from entering the atmosphere. Housing 10 is shown as a ball.

Figure 4:
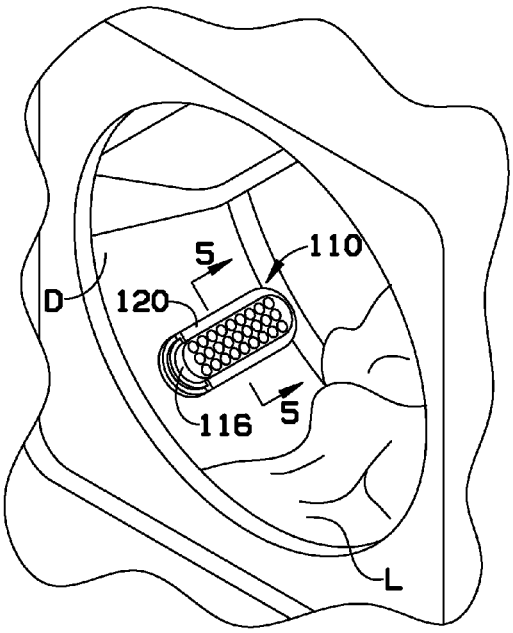
FIG. 4 is a detailed perspective view of an embodiment of the first alternate embodiment of the invention shown in use.
Figure 5:
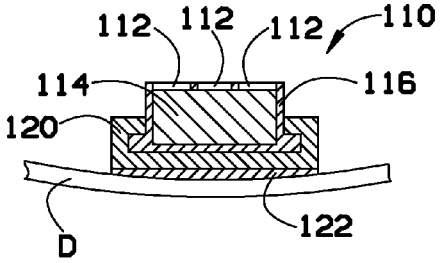
FIG. 5 is a section view of an embodiment of the invention taken about line 5-5 in FIG. 4.
Figure 6:
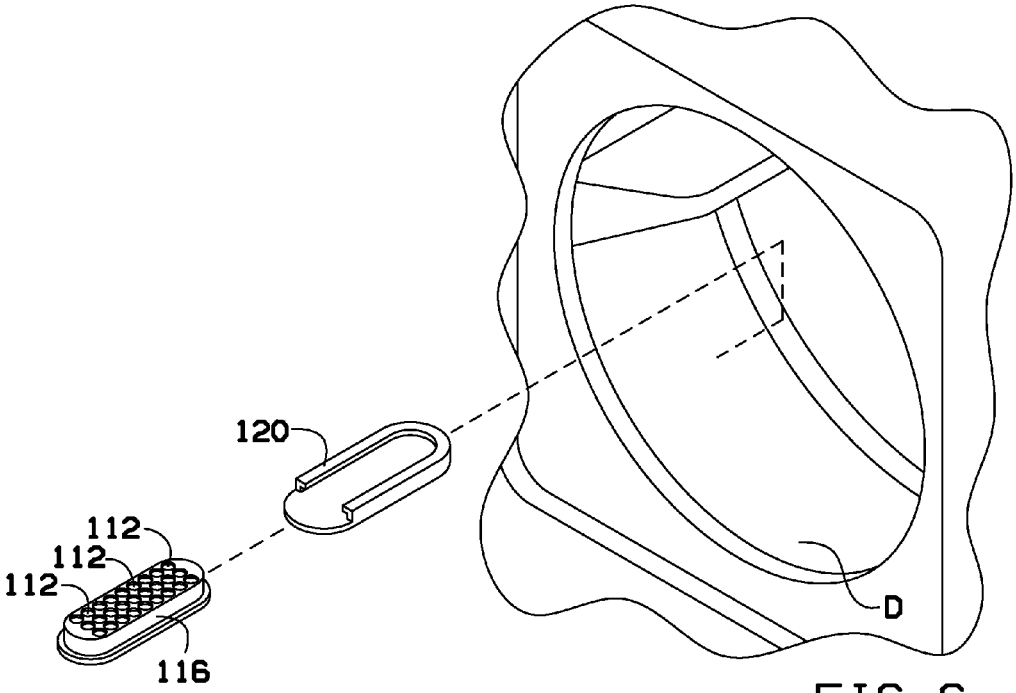
FIG. 6 is an exploded view of an embodiment of the invention.

Turning to FIG. 4, FIG. 5 and FIG. 6. Housing 110 comprises cartridge 116 which can be inserted into casing 120. Casing 120 can be held to dryer D with adhesive 122. Cartridge 116 holds desiccant 114 immediately adjacent to perforations 112 that permits moisture to travel through perforations 112 where the moisture is exposed to desiccant 114. This causes moisture to be removed from laundry L allowing laundry L to dry and preventing excessive moisture from entering the atmosphere. Housing 110 is shown as a bar.

Figure 7:
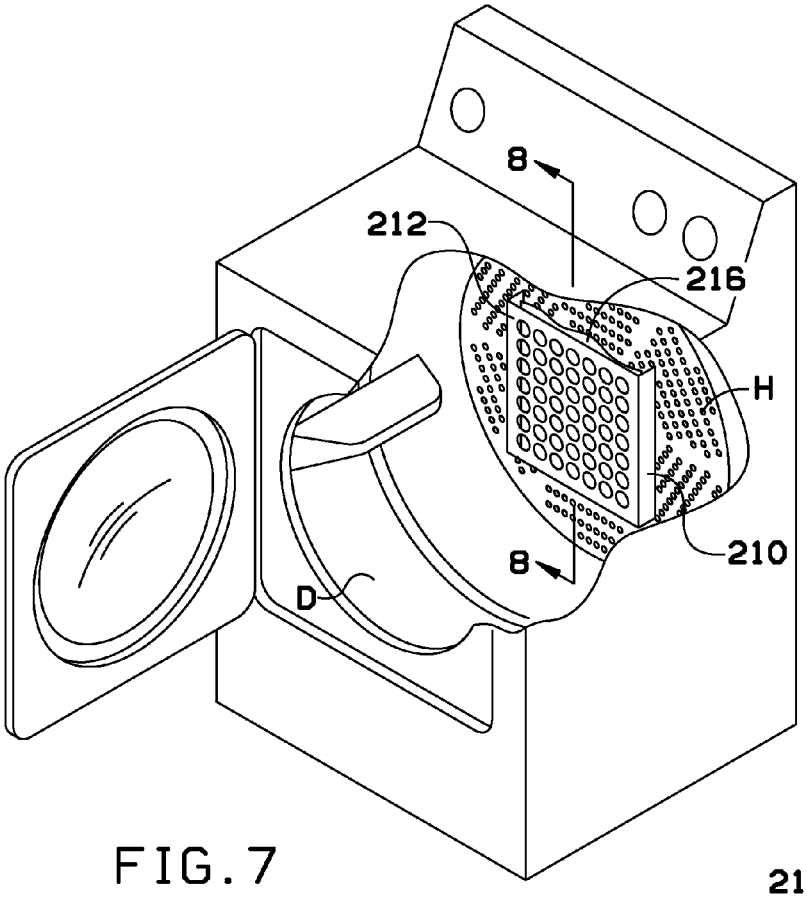
FIG. 7 is a perspective view of an embodiment of the invention shown in use.
Figure 8:
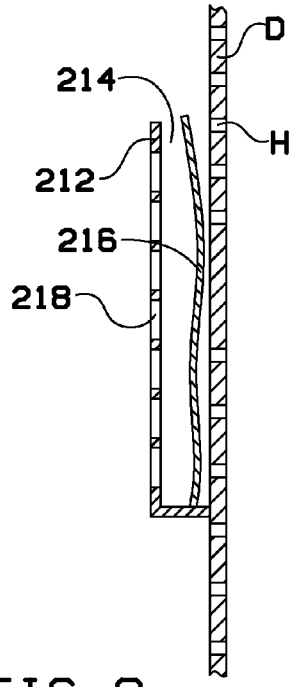
FIG. 8 is a section view of an embodiment of the invention taken about line 8-8 in FIG. 7.

Turning to FIG. 7 and FIG. 8. Housing 210 comprises bracket 212 mechanically coupled to dryer D. Bracket 212 can accommodate cartridge 116 which holds desiccant 214. Bracket 212 is perforated with perforations 218. Dryer D can push air through holes H, through desiccant 214 and perforations 218 before the dry air now enters dryer D. The air becomes moist from laundry L while removing some moisture from laundry L. The air is then pulled through perforations 218 and out of holes H. This causes moisture to be removed from laundry L allowing laundry L to dry and preventing excessive moisture from entering the atmosphere. Housing 210 is shown as a bracket assembly.

The desiccant can be any of a large number of known materials. For instance, Jerg suggests that a material that contains at least one of aluminum and silicon-oxide, a silica gel; and zeolite. The problem with this material is that it both moistens and dries air, which is fine for washing dishes, but it unhelpful for drying clothes and protecting the environment. A desiccant that works better is a molecular sieve such as activated charcoal and silica gel, though many other materials may also work. In some embodiments, five pounds of molecular sieve is sufficient to obtain a demonstrable reduction in humidity in the moist air. In any case, the system can be used for a process for removing moisture from clothes dryer D containing wet clothes that enables faster clothes drying and reduces an amount of moisture released from clothes dryer D into an ambient environment.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A system for reducing moisture within a clothes dryer, the system comprising:

a housing comprising holes which permit the moisture from to enter and leave the housing a cartridge located within the housing; wherein the cartridge is filled with a desiccant;

wherein the clothes dryer blows air continuously across the cartridge in many directions subjecting the desiccant to moist air in order to remove the moisture from the moist air and dry clothes in the clothes dryer faster.

2. The system of claim 1, wherein the housing is a ball.

3. The system of claim 1, wherein the housing is a bar affixed to the clothes dryer with an adhesive.

4. The system of claim 1, wherein the housing is a bracket assembly mechanically coupled to the clothes dryer.

5. The system of claim 1, wherein the desiccant is a molecular sieve.

6. A process for removing moisture from a clothes dryer containing wet clothes enables faster clothes drying and reduces an amount of moisture released from the clothes dryer into an ambient environment; the process comprising:

perforating a housing with perforations;

inserting a cartridge into the housing wherein the cartridge is filled with a desiccant;

engaging the clothes dryer to blow moist air continuously across the housing wherein the desiccant removes the moisture from the moist air permitting faster clothes drying and reducing the amount of moisture released from the clothes dryer into the ambient environment.

7. The process of claim 6, wherein the housing is a ball.

8. The process of claim 6, wherein the housing is a bar affixed to the clothes dryer with an adhesive.

9. The process of claim 6, wherein the housing is a bracket assembly mechanically coupled to the clothes dryer.

10. The process of claim 6, wherein the desiccant is a molecular sieve.

* * * * *